US009883271B2

(12) United States Patent
Sampat

(10) Patent No.: US 9,883,271 B2
(45) Date of Patent: Jan. 30, 2018

(54) SIMULTANEOUS MULTI-SOURCE AUDIO OUTPUT AT A WIRELESS HEADSET

(75) Inventor: Kuntal Sampat, San Diego, CA (US)

(73) Assignee: QUALCOMM Incorporated, San Diego, CA (US)

( * ) Notice: Subject to any disclaimer, the term of this patent is extended or adjusted under 35 U.S.C. 154(b) by 1367 days.

(21) Appl. No.: 12/334,205

(22) Filed: Dec. 12, 2008

(65) Prior Publication Data

US 2010/0150383 A1 Jun. 17, 2010

(51) Int. Cl.
*H04R 5/02* (2006.01)
*H04R 1/10* (2006.01)
*H04R 5/033* (2006.01)

(52) U.S. Cl.
CPC ..... *H04R 1/10* (2013.01); *H04R 1/1041* (2013.01); *H04R 5/033* (2013.01); *H04R 2420/01* (2013.01); *H04R 2420/07* (2013.01)

(58) Field of Classification Search
CPC . H04R 5/033; H04R 5/04; H04R 1/10; H04R 2201/107; H04R 2205/022; H04R 3/12; H04M 1/72597; H04M 11/08
USPC ..... 455/575.2, 556.1, 575.1; 381/376, 104, 381/106
See application file for complete search history.

(56) References Cited

U.S. PATENT DOCUMENTS 6,006,115 A * 12/1999 Wingate ..... 455/575.2
6,662,022 B1 * 12/2003 Kanamori et al. ..... 455/556.1
6,782,106 B1 8/2004 Kong et al.
6,954,652 B1 * 10/2005 Sakanashi ..... 455/550.1
8,155,335 B2 4/2012 Rutschman
2003/0161292 A1 8/2003 Silvester
2005/0096766 A1 * 5/2005 Nishioka et al. ..... 700/94
2005/0202857 A1 9/2005 Seshadri et al.
2006/0153007 A1 7/2006 Chester
2006/0166715 A1 * 7/2006 Van Engelen et al. .... 455/575.2
2006/0166716 A1 7/2006 Seshadri et al.
2006/0262938 A1 11/2006 Gauger, Jr. et al.
2007/0002955 A1 * 1/2007 Fechtel et al. ..... 375/260
2007/0038442 A1 2/2007 Visser et al.
(Continued)

FOREIGN PATENT DOCUMENTS

CN 1612205 A 5/2005
JP 5276593 A 10/1993
(Continued)

OTHER PUBLICATIONS

International Search Report and Written Opinion PCT/US2009/063270; International Searching Authority; dated Feb. 9, 2010.
(Continued)

*Primary Examiner* — Jesse Y Miyoshi
(74) *Attorney, Agent, or Firm* — Kilpatrick Townsend & Stockton, LLP

(57) ABSTRACT

A wireless headset supports simultaneous connections to two or more audio sources and can concurrently output audio from the different sources. The audio may include voice and/or audio playback, e.g., music playback. The wireless headset includes a first transceiver configured to receive a first audio input from a first source, a second transceiver configured to receive a second audio input from a second source, and an audio mixer configured to combine the first and second audio inputs into output audio.

30 Claims, 5 Drawing Sheets

(56) References Cited

U.S. PATENT DOCUMENTS

| | | | |
|---|---|---|---|
| 2007/0042762 | A1 | 2/2007 | Guccione |
| 2007/0129104 | A1 | 6/2007 | Sano et al. |
| 2007/0149261 | A1 | 7/2007 | Huddart |
| 2008/0161066 | A1 | 7/2008 | Reda et al. |
| 2008/0161067 | A1 | 7/2008 | Reda et al. |

FOREIGN PATENT DOCUMENTS

| | | | |
|---|---|---|---|
| JP | 2001313582 | A | 11/2001 |
| JP | 2005295253 | A | 10/2005 |
| JP | 2007142684 | A | 6/2007 |
| WO | WO0184727 | A1 | 11/2001 |
| WO | WO2009097009 | A1 | 8/2009 |

OTHER PUBLICATIONS

Taiwan Search Report—TW098138713—TIPO—Jan. 31, 2013.

* cited by examiner

SIMULTANEOUS MULTI-SOURCE AUDIO OUTPUT AT A WIRELESS HEADSET

BACKGROUND

Field

This disclosure generally relates to audio communications, and more particularly, to wireless headsets.

Background

Wired and wireless headsets are known. Conventional wired headsets include a wire running between an audio source and either one or two earpieces that are intended to fit on or within a user's ears. In many cases, wireless headsets are simply replacements for wired headsets. In such circumstances, a wireless headset substitutes a wireless link, usually a radio frequency (RF) or infrared (IR) channel, for the wire running between the headset and audio source. Wireless headsets are used to provide a greater degree of user freedom, as the user is no longer tethered to the audio source by a wire. It is known for both wired and wireless headsets to be used with audio sources such as communication devices, e.g., cordless telephones, mobile radios, personal digital assistants (PDAs), cellular subscriber units and the like, as well as other source devices, such as MP3 players, stereo systems, radios, video games, personal computers, laptop computers and the like.

Known wireless headsets communicate with audio sources using RF or IR wireless technology. Such wireless headset communications have been extended to personal wireless networks, such as the one defined by the Bluetooth Specification available at www.bluetooth.com. The Bluetooth Specification provides specific guidelines for providing wireless headset functionality. In particular, the Bluetooth Specification provides a Headset Profile that defines the requirements for Bluetooth devices necessary to support the Headset use case. Once configured, the headset can function as a device's audio input and/or output. Thus, a particularly popular use of Bluetooth networks is to provide wireless headset connectivity for cellular telephones and PDAs. In addition, the Bluetooth Specification also provides the Advanced Audio Distribution Profile (A2DP) that defines protocols and procedures for wirelessly distributing high-quality stereo or mono audio over a Bluetooth network. The purpose of this Profile is to connect to MP3 music players such as the Zune, iPod, and the like.

Although wireless headsets are an improvement over wired headsets in some circumstances, there are still opportunities to further improve wireless headsets.

SUMMARY

Known wireless headsets do not support simultaneous, direct connections to two or more separate source devices. Thus, for users who have two or more separate audio source devices, it is not currently possible to simultaneously listen to the different devices using known headsets. For example, presently available wireless headsets can not independently output simultaneous voice calls and playback audio, e.g., a user can not hear an incoming cellular phone voice-call while playing music from an MP3 player. The ability to simultaneously hear audio from different sources greatly improves the usability of wireless headset because, among other things, it allows a user to be conveniently notified of events, such as incoming voice-calls during music playback from his/her MP3 player.

Disclosed herein is a new and improved wireless headset design that supports simultaneous connections to two or more audio sources and that can concurrently output audio from the different sources. The audio may include voice-calls and audio playback, e.g., playback of recorded or streaming music.

According to one aspect of the design, a wireless headset includes a first transceiver configured to receive a first audio input from a first source, a second transceiver configured to receive a second audio input from a second source, and an audio mixer configured to combine the first and second audio inputs into output audio.

According to another aspect of the design, a method for outputting audio at a wireless headset includes receiving, at the wireless headset, first and second audio inputs from different sources and mixing the first and second audio inputs into output audio.

According to an another aspect of the design, an apparatus includes means for receiving at a wireless headset a first audio input from a first source, means for receiving at the wireless headset a second audio input from a second source, means for mixing the first and second audio inputs into output audio, and means for outputting the output audio from the wireless headset.

According to a further aspect of the design, a computer-readable medium, embodying a set of instructions executable by one or more processors, includes code for receiving a first audio input from a first source, code for receiving a second audio input from a second source, code for mixing the first and second audio inputs into output audio, and code for outputting the output audio from a wireless headset.

Other aspects, features, processes and advantages of the wireless headset design will be or will become apparent to one with skill in the art upon examination of the following figures and detailed description. It is intended that all such additional features, aspects, processes and advantages be included within this description and be protected by the accompanying claims.

BRIEF DESCRIPTION OF THE DRAWINGS

It is to be understood that the drawings are solely for purpose of illustration. Furthermore, the components in the figures are not necessarily to scale, emphasis instead being placed upon illustrating the principles of the wireless headset design and its various aspects. In the figures, like reference numerals designate corresponding parts throughout the different views.

DETAILED DESCRIPTION

The following detailed description, which references to and incorporates the drawings, describes and illustrates one or more specific embodiments. These embodiments, offered not to limit but only to exemplify and teach, are shown and described in sufficient detail to enable those skilled in the art to practice what is claimed. Thus, for the sake of brevity, the description may omit certain information known to those of skill in the art.

The word "exemplary" is used throughout this disclosure to mean "serving as an example, instance, or illustration." Any embodiment or feature described herein as "exemplary" is not necessarily to be construed as preferred or advantageous over other embodiments or features.

Figure 1:
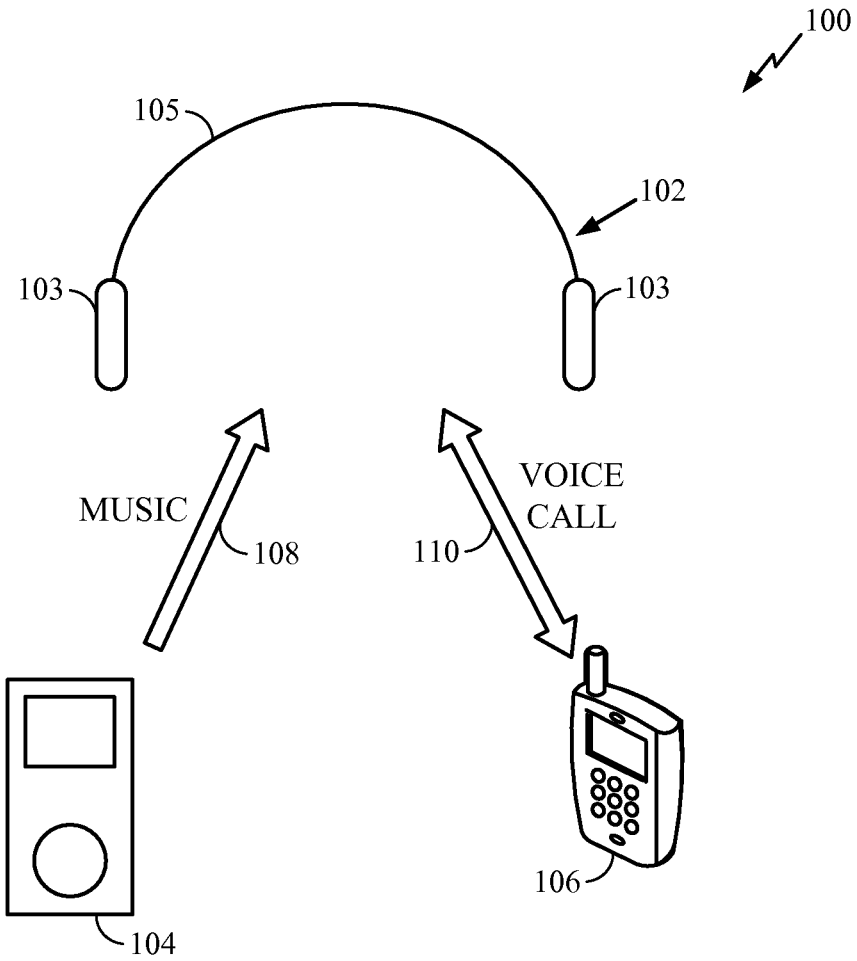
FIG. 1 is a diagram showing a wireless headset system.

Turning now to the drawings, and in particular to FIG. 1, there is shown a wireless headset system 100. The system 100 includes a wireless headset 102 in communication with one or more audio sources, e.g., a first audio source, such as an MP3 music player 104, and a second audio source, such as a cellular phone 106. Although illustrated as an MP3 player 104 and cellular phone 106, the audio sources may be any device capable of transmitting and/or receiving audio signals to/from the headset 102 such that the audio represented by the audio signals can be output from speakers in the headset 102. Each audio source may be a communication device, e.g., cordless telephone, mobile radio, personal digital assistant (PDA), cellular subscriber unit or the like, or alternatively, another type of device, such as an MP3 player, stereo system, audiovisual system, radio, video game, personal computer, laptop computer or the like.

The audio signals transmitted to and from the headset 102 can represent any form of discernable sound, including but not limited to voice and monaural or stereo audio. The audio signals transmitted between the audio sources and the headset 102 over the wireless channels can represent digitized audio sampled at the industry standard rate of 44.1 KHz. Other standard rates are 8 kHz, 16 kHz, 48 kHz, and other rates may also be used.

The wireless headset 102 communicates with the audio sources via plural wireless channels, e.g., radio frequency (RF) or infrared channels. In the exemplary system 100, the MP3 player 104 plays back music, which is transmitted as wireless signals by way of a first wireless channel 108 to the headset 102 where it can be rendered and heard by a user. The signals on the first wireless channel 108 may represent stereo or monaural audio. The cellular phone 106 can place and receive voice calls over a cellular network. The cellular phone 106 transmits and receives voice-call information, including voice itself, to and from the headset 102 as wireless signals over a second wireless channel 110.

The exemplary wireless headset 102 includes two earpieces 103 and at least one support, such as a headband 105, for allowing the headset 102 to be comfortably worn by a user. The wireless headset 102 is configured to simultaneously receive audio information over both the first and second wireless channels 108, 110 and to mix the received audio information so that it can be combined and output together at the earpieces 103, thus allowing the user to simultaneously hear audio from both sources. In known Bluetooth headsets, only one Bluetooth transceiver is present. This transceiver can typically be "paired" with up to four different devices. However, only one paired device at a time can exchange information with the headset transceiver. Thus, with a conventional Bluetooth headset, a user can listen to only one audio source at a time. In contrast to conventional Bluetooth headsets, the wireless headset 102 includes two or more wireless transceivers. Each transceiver may be paired with a different source device, for example, one with the phone 106 and another with the MP3 player 104. The audio from the sources is mixed within the headset 102. The mixed audio output from the source devices is then output from speakers in the headset 102.

To control multiple source devices, the headset 102 may include a user interface to select the device to be controlled.

To support multiple transceivers on the headset 102, an audio mixer 206 (FIGS. 2A-C) is included in the headset 102. The audio mixer 206 includes a matrix element 208 (FIGS. 2A-C) that intelligently mixes the audio from each source and then outputs it to the headset speakers. This allows an enhanced listening experience, even when music playback and voice-calls are provided by separate devices. The audio mixer 206 may apply a different gain to each audio path. The mixer 206 may also modify the gains in a time-varying manner.

Although illustrated with the headband 105, the headset 102 and earpieces 103 can having any suitable physical shape and size adapted to securely fit the earpieces 103 over or into a user's ears. The headband 105 may be optionally omitted from the headset 102. For example, the earpieces 103 can be conventional hook-shaped earpieces for attaching behind a user's earlobe and over or into the user's ear canal. In addition, although the headset 102 is illustrated as having two earpieces 103, the headset 102 may alternatively include only a single earpiece.

Figure 2A:
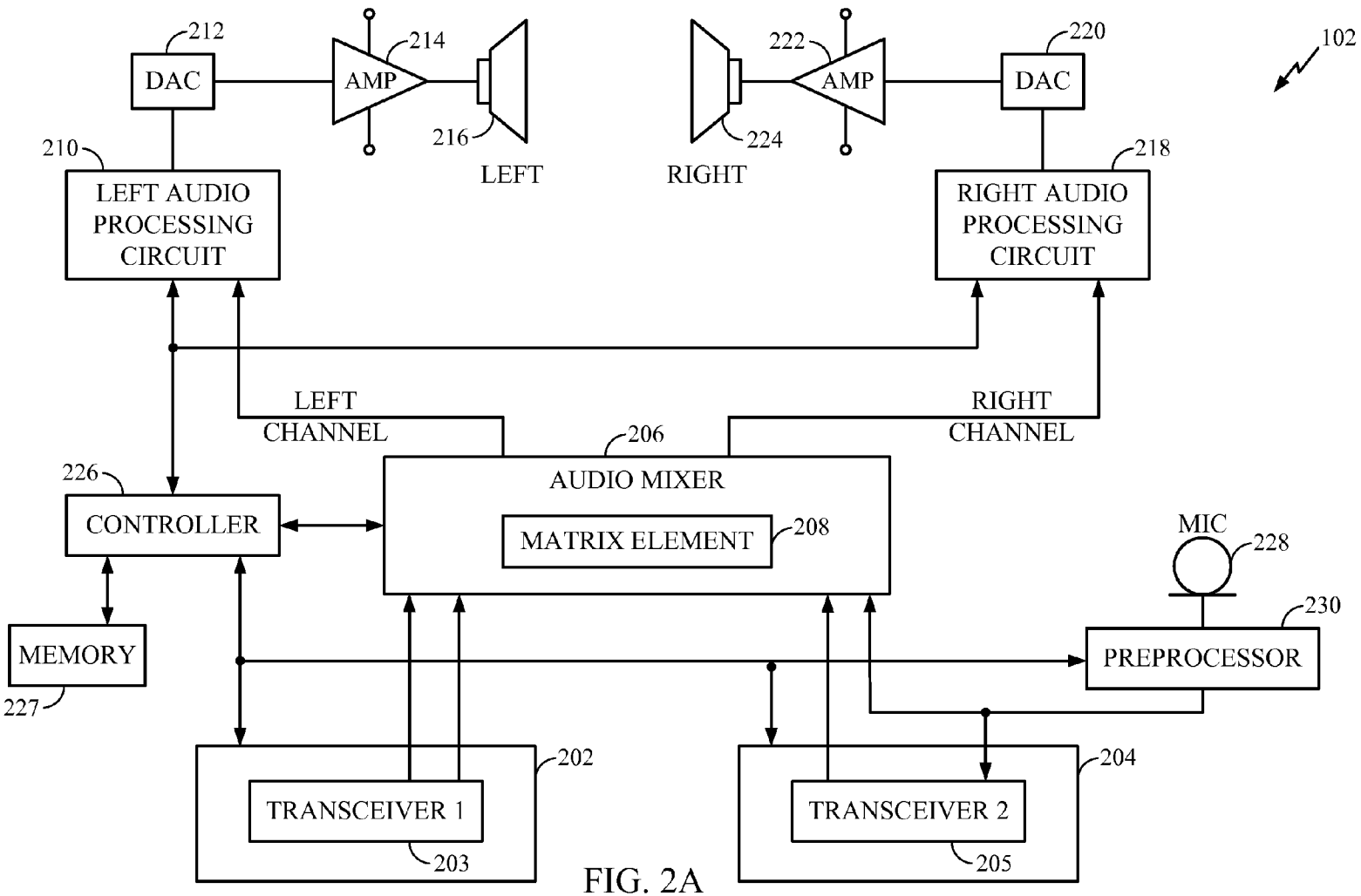
FIG. 2A is a conceptual block diagram illustrating components of the wireless headset of FIG. 1.

FIG. 2A is a conceptual block diagram illustrating an exemplary arrangement of certain components of the wireless headset 102 of FIG. 1. The wireless headset 102 includes a first wireless interface 202 having a first transceiver 203 configured to receive first audio input from a first audio source (e.g., MP3 player 104), a second wireless interface 204 having a second transceiver 205 configured to receive second audio input from a second source (e.g., cellular phone 106), and an audio mixer 206 configured to combine the first and second audio streams into output audio. The headset 102 may include more than two wireless interfaces and transceivers in order to handle more than two audio sources.

The headset 102 also includes a controller 226 coupled to a memory 227, a left-channel audio processing circuit 210, a left-channel digital-to-analog converter (DAC) 212, a left-channel high-impedance headphone (HPH) amplifier (Amp) 214, a left-channel earphone speaker 216, a right-channel audio processing circuit 218, a right-channel DAC 220, a right-channel HPH amp 222, and a right-channel earphone speaker 224.

The headset 102 may also include an optional microphone (MIC) 228 configured to produce a third audio stream that is preprocessed by microphone preprocessor 230 and then provided to one of the transceivers 202, 204, e.g., the second transceiver 204, where it is further processed and then passed to the audio mixer 206. When the microphone 228 is included in the headset 102, the audio mixer 206 is configured to combine the first, second and third audio streams into the output audio.

The microphone 228 is any suitable microphone device for converting sound into electronic signals.

The microphone preprocessor 230 is configured to process electronic signals received from the microphone 228. The microphone preprocessor 230 may include an analog-to-digital converter (ADC) and a noise reduction and echo cancellation circuit (NREC). The ADC converts analog signals from the microphone into digital signal that are then processed by the NREC. The NREC is employed to reduce undesirable audio artifacts for communications and voice control applications. The microphone preprocessor 230 may be implemented using commercially-available hardware, software, firmware, or any suitable combination thereof.

The controller 226 controls the overall operation of the headset 102 and certain components contained therein. The controller 226 can be any suitable control device for causing the headset 102 to perform its functions and processes as described herein. For example, the controller 226 can be a processor for executing programming instructions stored in the memory 227, e.g., a microprocessor, such as an ARM 7, or a digital signal processor (DSP), or it can be implemented as one or more application specific integrated circuits (ASICs), field programmable gate arrays (FPGAs), complex programmable logic devices (CPLDs), discrete logic, software, hardware, firmware or any suitable combination thereof.

The memory 227 is any suitable memory device for storing programming instructions and data executed and used by the controller 226.

Figure 2B:
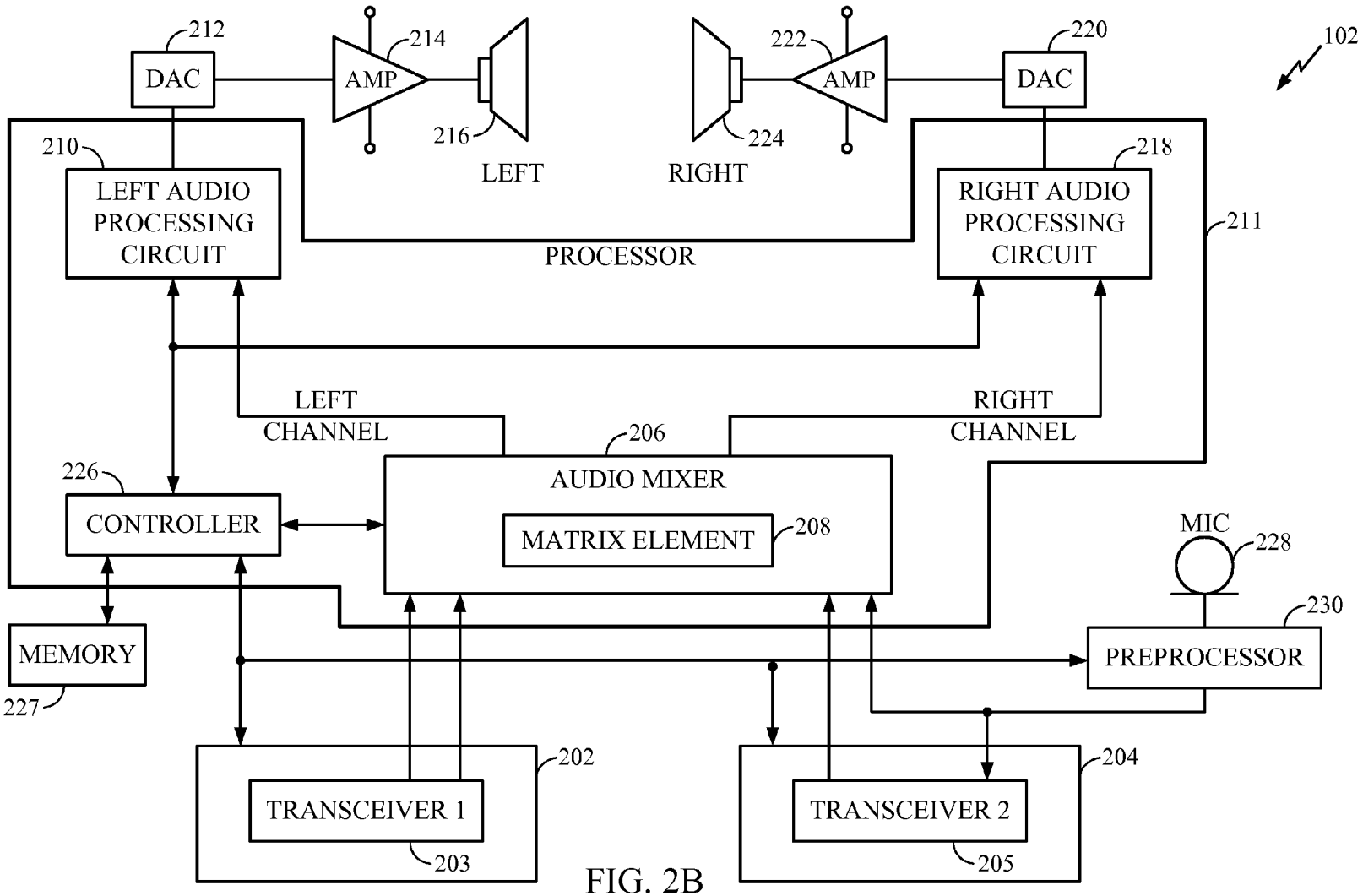
FIG. 2B is a conceptual block diagram illustrating an exemplary implementation of headset components.
Figure 2C:
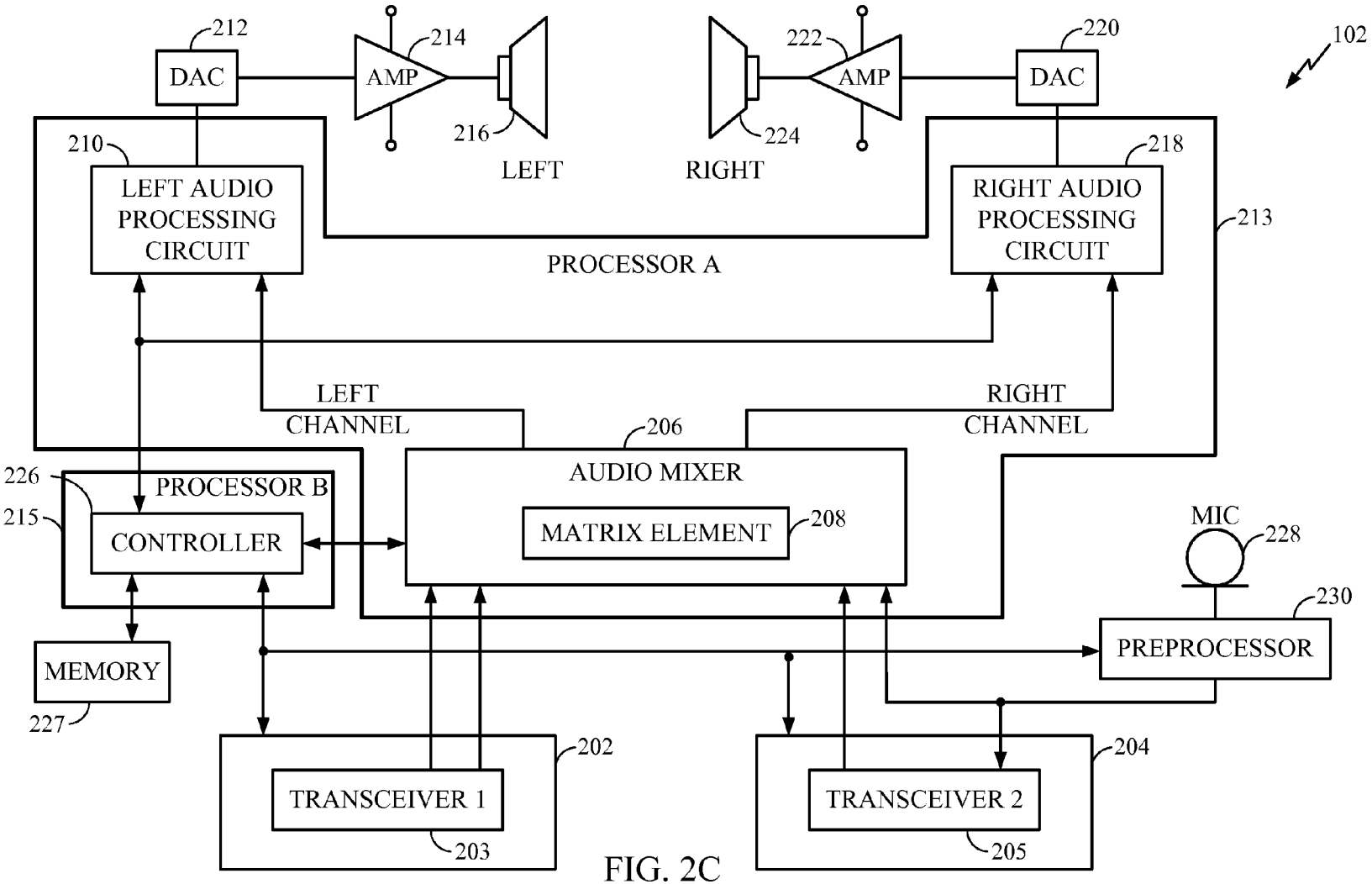
FIG. 2C is a conceptual block diagram illustrating a second exemplary implementation of headset components.

The wireless interfaces 202, 204 each provide two-way wireless communications with the first and second audio sources 104, 106, respectively. Preferably, each wireless interface 202, 204 includes a commercially-available Bluetooth module that provides at least a Bluetooth core system consisting of a Bluetooth RF transceiver, baseband processor, protocol stack, as well as hardware and software interfaces for connecting the module to the controller 226 and audio mixer 206. Although any suitable wireless technology can be employed with the headset 102, the first and second transceivers 203, 205 as illustrated in FIGS. 2A-C, are each a Bluetooth transceiver. Each of the wireless interfaces 202, 204 may be controlled by controller 226.

Digitized audio streams are output from the first and second wireless interfaces 202, 204 and received by the audio mixer 206. The format of the digitized audio streams may be any suitable format, and thus, the audio streams may, in some circumstances, be raw audio samples, such as pulse code modulation (PCM) samples, or in other circumstances, digitally encoded and/or compressed audio, such MP3 audio. The controller 226 may be configured to detect the incoming audio stream formats from each wireless interface 202, 204 and then configure the audio mixer 206, audio processing circuit 210, 218 and other components, as necessary, to process and/or decode the incoming audio streams in a manner so that the streams can be appropriately mixed and output through speakers 216, 224 to be meaningfully heard by a user. Encoded and/or compressed audio is typically decoded and/or decompressed prior to being passed to the audio mixer 206.

In the exemplary headset configurations shown in FIGS. 2A-C, the first wireless interface 202 is configured to receive Bluetooth stereo audio and output digitized left-channel and right-channel audio streams, and the second wireless interface 204 is configured to receive Bluetooth voice and output a digitized voice stream.

The audio mixer 206 mixes the incoming audio streams from the wireless interfaces 202, 204 to produce mixed audio signals, and in this case, left-channel and right-channel mixed digitized audio streams. The audio mixer 206 includes a matrix element 208 configured to weight each of the first and second audio streams, and also a third microphone audio stream, if present, thereby producing weighted audio signals The matrix element 208 may also be configured to sum the weighted audio signals to produce one or more output streams.

The matrix element 208 may include one or more digital weighted sum circuits and its operation can be represented mathematically using matrix algebra. The matrix element output may be represented by the vector Y, its input by the vector X and the weighting coefficients by a matrix M, and thus, the operation of the matrix element 208 is described using matrix algebra as Y=MX.

In the exemplary headset circuits shown in FIGS. 2A-C, the matrix element 208 has four inputs: two stereo audio input streams (left and right inputs) from the first wireless interface 202, and voice and microphone input audio streams from the second wireless interface 204. The inputs are represented by the vector shown in Equation 1.

$$X = \begin{bmatrix} x_1 \\ x_2 \\ x_3 \\ x_4 \end{bmatrix} \tag{1}$$

where: $x_1$=left-channel stereo audio input
$x_2$=right-channel stereo audio input
$x_3$=voice input
$x_4$=microphone input The inputs, $x_1$, $x_2$, $x_3$, $x_4$, to the matrix element 208 may be digital data representing a predefined duration of input audio.

The matrix element 208 has two outputs: left-channel speaker and right-channel speaker, represented by the vector shown in Equation 2.

$$Y = \begin{bmatrix} y_1 \\ y_2 \end{bmatrix} \tag{2}$$

where: $y_1$=left channel audio output
$y_2$=right channel audio output

The outputs, $y_1$, $y_2$, of the matrix element 208 may be digital data representing a predefined duration of audio.

The coefficient matrix M may be represented by a 2×4 matrix:

$$M = \begin{bmatrix} a_1 & b_1 & c_1 & d_1 \\ a_2 & b_2 & c_2 & d_2 \end{bmatrix} \tag{3}$$

where the elements of M are pre-selected variable values or constants.

Thus, the matrix element output, Y=MX, can be written as the system of equations:

$$y_1=a_1x_1+b_1x_2+c_1x_3+d_1x_4$$
$$y_2=a_2x_1+b_2x_2+c_2x_3+d_2x_4 \tag{4}$$

The audio mixer 206 may be programmably configured to select different weighting coefficient matrix configurations, and therefore, different mixings of the incoming audio streams. The streams can be combined such that the audio mixer output includes only the first audio stream. The streams can alternatively be combined to include only the second audio stream in the output audio, or to include a mixture of both the first and second audio streams in the output audio.

For example, to configure the headset 102 to play stereo audio only, the matrix M of weighting coefficients may be set to:

$$M = \begin{bmatrix} 1 & 0 & 0 & 0 \\ 0 & 1 & 0 & 0 \end{bmatrix} \tag{5}$$

Thus, applying the matrix of Equation 5 into Equation 4, the operation and outputs of the matrix element 208 are described as shown below in Equation 6:

$$y_1=x_1$$
$$y_2=x_2 \tag{6}$$

To configure the headset 102 to play voice only, evenly distributed in both earpiece speakers 216, 224, the matrix M of weighting coefficients may be set to:

$$M = \begin{bmatrix} 0 & 0 & 0.5 & 0 \\ 0 & 0 & 0.5 & 0 \end{bmatrix} \tag{7}$$

Thus, applying the matrix of Equation 7 into Equation 4, the operation and outputs of the matrix element 208 are described as shown below in Equation 8:

$$y_1=0.5x_3$$

$$y_2=0.5x_3 \tag{8}$$

To configure the headset 102 to play stereo audio combined with voice, evenly distributed in both earpiece speakers 216, 224, the matrix M of weighting coefficients may be set to:

$$M = \begin{bmatrix} 1 & 0 & 0.5 & 0 \\ 0 & 1 & 0.5 & 0 \end{bmatrix} \tag{9}$$

Thus, applying the matrix of Equation 9 into Equation 4, the operation and outputs of the matrix element 208 are described as shown below in Equation 10:

$$y_1=x_1+0.5x_3$$

$$y_2=x_2+0.5x_3 \tag{10}$$

Additionally, the elements of the matrix M can be time-varying to produce advanced effects, such as fade-in, fade-out or the like. The matrix M elements can be stored as data sets in the memory 227, and can be configured by the controller 226. The matrix M elements can also apply gains to the audio inputs, and the gains may also be made time-varying by changing the value(s) of one or more of the matrix elements over time.

The functions of the audio mixer 206 and matrix element 208 may be implemented using any suitable analog and/or digital circuitry. For example, in the digital domain, the audio mixer 206 and matrix element 208 may be implemented in software executable by a processor, e.g, a microprocessor, such as an ARM7, or a digital signal processor (DSP), or they may be implemented as one or more application specific integrated circuits (ASICs), field programmable gate arrays (FPGAs), complex programmable logic devices (CPLDs), discrete logic, software, hardware, firmware or any suitable combination thereof.

The mixed digitized audio streams output by the audio mixer 206 are provided to the left-channel and right-channel audio processing circuits 210, 218.

The left-channel audio processing circuit 210 receives the mixed digitized audio stream from the left channel output of the audio mixer 206. The audio processing circuit 210 includes digital circuitry to process the mixed digitized audio signals in the digital domain. For example, the left-channel mixed digitized audio stream may be truncated one or more times, filtered one or more times, amplified one or more times, and upsampled one or more times by the audio processing circuit 210. Filtering may include low pass filtering, high pass filtering, and/or passing the stream through filters characterized by other kinds of filter functions. Amplification in the digital domain may include the use of a programmable gain amplifier (PGA).

The right-channel audio processing circuit 218 receives the mixed digitized audio stream from the right channel output of the audio mixer 206. The audio processing circuit 218 includes digital circuitry to process the right-channel mixed digitized audio signals in the digital domain. For example, the right-channel mixed digitized audio stream may be truncated one or more times, filtered one or more times, amplified one or more times, and upsampled one or more times by the audio processing circuit 218. Filtering may include low pass filtering, high pass filtering, and/or passing the stream through filters characterized by other kinds of filter functions. Amplification in the digital domain may include the use of a programmable gain amplifier (PGA).

The left-channel and right-channel audio processing circuits 210, 218 may be implemented using commercially-available, off-the-shelf components. Additionally, the audio processing circuits 210, 218 may be combined into a single, multiplexed processing path that handles both left and right audio channels. Also, some or all of the functions of the audio processing circuits 210, 218 may be implemented as software executable on a processor.

The left-channel DAC 212 converts left-channel mixed digitized audio output from the left-channel audio processing circuit 210 into a left-channel analog audio signal. The left channel analog audio signal is then amplified by the audio amplifier 214 to drive the left speaker 216.

The right-channel DAC 220 converts right-channel mixed digitized audio output from the right-channel audio processing circuit 218 into a right-channel analog audio signal. The right-channel analog audio signal is then amplified by the audio amplifier 222 to drive the right speaker 224.

One of ordinary skill in the art will understand that additional analog audio processing circuitry (not shown), beyond the audio amplifiers 214, 222, may be included in the headset 102.

The left and right headset speakers 216, 224 are any suitable audio transducer for converting the electronic signals output from the amplifiers 214, 222, respectively, into sound.

To save power, the controller 226 can switch off certain audio paths within the headset 102 when they are not in use. For example, if voice is not being received at the headset 102 and only stereo audio is being received, the controller 226 can temporarily switch off the second wireless interface 204 and microphone preprocessor 230.

An alternative arrangement of the headset components is to have the first transceiver's output be sent to second transceiver 205, before or after the matrix element 208. This would allow music from an audio source connected to the first wireless interface 202 to be sent to a remote station or second source communicating with the headset 102 via the second wireless interface 204.

FIG. 2B is a conceptual block diagram illustrating an exemplary implementation of components for the headset 102 of FIG. 1. In this implementation, the left-channel and right-channel audio processing circuits 210, 218, audio mixer 206, matrix element 208 and controller 226 are implemented using a single processor 211, e.g., a microprocessor, such as an ARM7, a DSP or the like. The left and right DACs 212, 220, wireless interfaces 202, 204, memory 227 and microphone preprocessor 230 are interfaced to the processor 213.

In an alternative implementation (not shown), the memory 227, wireless interfaces 202 and 204, as well as the first and second transceivers 203, 205 may also be included in the processor 211.

FIG. 2C is a conceptual block diagram illustrating another exemplary implementation of headset components. In the second exemplary implementation, multiple processors are used to implement at least some of the headset circuitry. In the example shown in FIG. 2C, the controller 226 is implemented using a processor 215, e.g., a microprocessor, and the left-channel and right-channel audio processing circuits 210, 218, audio mixer 206 and matrix element 208 are implemented using a second processor 213, such as a DSP.

Other implementations of the headset circuitry are possible.

Figure 3:
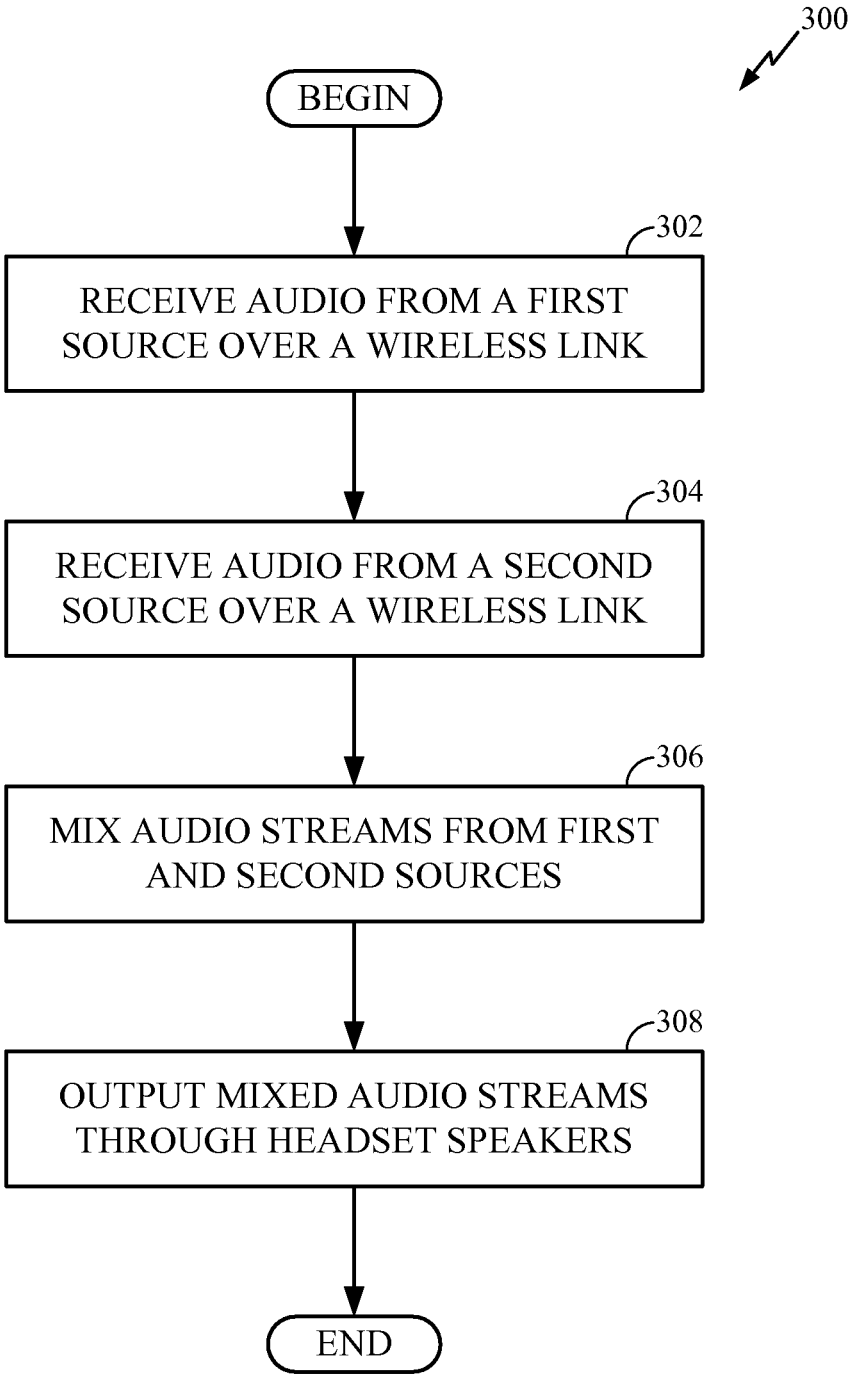
FIG. 3 is a flowchart illustrating the operation of the headset shown in FIGS. 1 and 2A-C.

FIG. 3 is a flowchart 300 illustrating the operation of the headset 102 shown in FIGS. 1 and 2A-C. Generally, the method is performed under the control of the controller 226, coordinating operations of the various components of the headset 102.

In block 302, audio from a first audio source, e.g., MP3 player 104, is received by the headset 102 over the first wireless channel 108. The audio may include Bluetooth streaming audio resulting from a connection established between the MP3 104 and the headset 102, as described in the A2DP specification. After the Bluetooth streaming audio connection is established, audio packets are transmitted from the first audio source to the headset 102. Generally, the audio packets include digitized audio that is encoded using a negotiated codec standard. Each audio packet represents a predetermined duration of sound, e.g., 20 milliseconds, that is to be output at the headset 102. The audio packets can be formatted according to the A2DP profile, including one or more frames of encoded audio. The audio can be encoded using any suitable audio codec, including but not limited to SBC, MPEG-1 audio, MPEG-2 audio.

In block 304, audio from a second audio source, e.g., cellular phone 106, is received by the headset 102 over the second wireless channel 110. The audio from the second source may be in a different format from the audio from the first source. If so, the controller 226 can perform any necessary decoding and/or additional processing to render the audio stream so that they can be compatibly mixed by the audio mixer 206.

Next, in block 306, audio streams from the two sources are mixed together into an output audio stream. The audio mixer 206 and matrix element 208 can perform this step. The functions of these components are discussed above in connection with FIGS. 2A-C.

In block 308, the mixed audio is processed by the audio processing circuits 210, 218, DACs 212, 220 and output through the headphone speakers 216, 224 of the wireless headset 102.

Although specific implementations of headset circuits have been described above, the functions of the headset circuitry and its components, as well as the method steps described herein may be implemented in any suitable combinations of hardware, software, and/or firmware, where such software and/or firmware is executable by one or more digital circuits, such as microprocessors, DSPs, embedded controllers, or intellectual property (IP) cores. If implemented in software, the functions may be stored on or transmitted as instructions or code on one or more computer-readable media. Computer-readable media include both computer storage medium and communication medium, including any medium that facilitates transfer of a computer program from one place to another. A storage medium may be any available medium that can be accessed by a computer. By way of example, and not limitation, such computer-readable medium can comprise RAM, ROM, EEPROM, CD-ROM or other optical disk storage, magnetic disk storage or other magnetic storage devices, or any other medium that can be used to carry or store desired program code in the form of instructions or data structures and that can be accessed by a computer. Also, any connection is properly termed a computer-readable medium. For example, if the software is transmitted from a website, server, or other remote source using a coaxial cable, fiber optic cable, twisted pair, digital subscriber line (DSL), or wireless technologies such as infrared, radio, and microwave, then the coaxial cable, fiber optic cable, twisted pair, DSL, or wireless technologies such as infrared, radio, and microwave are included in the definition of medium. Disk and disc, as used herein, includes compact disc (CD), laser disc, optical disc, digital versatile disc (DVD), floppy disk and blu-ray disc where disks usually reproduce data magnetically, while discs reproduce data optically with lasers. Combinations of the above should also be included within the scope of computer-readable medium.

Other embodiments and modifications will occur readily to those of ordinary skill in the art in view of these teachings. Therefore, the following claims are intended to cover all such embodiments and modifications when viewed in conjunction with the above specification and accompanying drawings.

What is claimed is:

1. A wireless headset, comprising:

a first transceiver configured to receive a first audio input from a first source;

a second transceiver configured to receive a second audio input from a second source;

a memory configured to store a plurality of audio signal weighting coefficient sets, wherein each of the weighting coefficient sets corresponds to a predetermined mix of the first audio input and the second audio input, and each of the weighting coefficient sets includes a plurality of programmable digital weighting coefficient values;

a controller configured to change the weighting coefficient values stored in the memory; and an audio mixer, coupled to the memory, configured to:

select one of the weighting coefficient sets stored in the memory, the selected weighting coefficient set associated with a desired mix of the first audio input and the second audio input;

weight the first audio input and the second audio input with the weighting coefficient values of the selected weighting coefficient set to produce a weighted first audio input and a weighted second audio input, wherein at least one of the weighting coefficient values weights the first audio input from the first source and at least one other of the weighting coefficient values weights the second audio input from the second source, and combine the weighted first audio input and the weighted second audio input into output audio.

2. The wireless headset of claim 1, wherein the audio mixer is configured to output a left-channel audio output, $y_1$, and a right-channel audio output, $y_2$, where $$y_1=a_1x_1+b_1x_2+c_1x_3+d_1x_4$$

$$y_2=a_2x_1+b_2x_2+c_2x_3+d_2x_4,$$

where: $x_1$ represents a left stereo channel included in the first audio input, $x_2$ represents a right stereo channel included in the first audio input, $x_3$ represents the second audio input, $x_4$ represents a microphone input, and $a_1$, $a_2$, $b_1$, $b_2$, $c_1$, $c_2$, $d_1$, $d_2$ represent the weighting coefficients.

3. The wireless headset of claim 1, wherein the audio mixer is configured to sum the weighted first audio input and the weighted second audio input.

4. The wireless headset of claim 1, wherein the audio mixer selectively combines the weighted first audio input and the weighted second audio input by:

including only the weighted first audio input in the output audio;

including only the weighted second audio input in the output audio; or including both the first audio input and the second audio input in the output audio.

5. The wireless headset of claim 1, wherein the first audio input represents voice.

6. The wireless headset of claim 5, wherein the second audio input represents stereo audio.

7. The wireless headset of claim 1, further comprising a microphone configured to produce a third audio input, wherein the audio mixer is configured to combine the weighted first audio input, the weighted second audio input and the third audio input into the output audio.

8. The wireless headset of claim 1, wherein the first transceiver and the second transceiver are Bluetooth transceivers.

9. The wireless headset of claim 1, wherein the weighting coefficients are stored in the memory as a predetermined two-dimensional matrix of coefficients.

10. A method for outputting audio at a wireless headset, comprising:

receiving, at a first transceiver included in the wireless headset, a first audio input from a first source;

receiving, at a second transceiver included in the wireless headset, a second audio input from a second source;

storing a plurality of audio signal weighting coefficient sets in a memory included in the wireless headset, wherein each of the weighting coefficient sets corresponds to a predetermined mix of the first audio input and the second audio input and includes a plurality of programmable digital weighting coefficient values;

changing the weighting coefficient values stored in the memory with a controller;

selecting one of the weighting coefficient sets stored in the memory, the selected weighting coefficient set associated with a desired mix of the first audio input and the second audio input;

retrieving the selected weighting coefficient set from the memory;

weighting the first audio input and the second audio input with the weighting coefficient values of the selected weighting coefficient set to produce a weighted first audio input and a weighted second audio input, wherein at least one of the weighting coefficient values weights the first audio input from the first source and at least one other of the weighting coefficient values weights the second audio input from the second source;

mixing the weighted first audio input and the weighted second audio input into output audio; and outputting the output audio from the wireless headset.

11. The method of claim 10, wherein mixing includes:

summing the weighted first audio input and the weighted second audio input.

12. The method of claim 10, wherein mixing includes selectively combining the weighted first audio input and weighted second audio input by:

including only the weighted first audio input in the output audio;

including only the weighted second audio input in the output audio; or including both the weighted first audio input and weighted second audio input in the output audio.

13. The method of claim 10, wherein the first audio input represents voice.

14. The method of claim 13, wherein the second audio input represents stereo audio.

15. The method of claim 10, further comprising:

receiving a third audio input from a microphone; and mixing the weighted first audio input, the weighted second audio input and the third audio input into the output audio.

16. The method of claim 10, wherein the first audio input and the second audio input are received at a first Bluetooth transceiver and a second Bluetooth transceiver, respectively.

17. A non-transitory computer-readable medium embodying a set of instructions executable by one or more processors, comprising:

code for receiving, at a first transceiver included in a wireless headset, a first audio input from a first source;

code for receiving, at a second transceiver included in the wireless headset, a second audio input from a second source;

code for storing a plurality of audio signal weighting coefficient sets in a memory included in the wireless headset, wherein each of the weighting coefficient sets corresponds to a predetermined mix of the first audio input and the second audio input and includes a plurality of programmable digital weighting coefficient values;

code for changing the weighting coefficient values stored in the memory with a controller;

code for selecting one of the weighting coefficient sets stored in the memory, the selected weighting coefficient set associated with a desired mix of the first audio input and the second audio input;

code for retrieving the selected weighting coefficient set from the memory;

code for weighting the first audio input and the second audio input with the weighting coefficient values of the selected weighting coefficient set to produce a weighted first audio input and a weighted second audio input, wherein at least one of the weighting coefficient values weights the first audio input from the first source and at least one other of the weighting coefficient values weights the second audio input from the second source;

code for mixing the weighted first audio input and the weighted second audio input into output audio; and code for outputting the output audio from the wireless headset.

18. The computer-readable medium of claim 17, wherein code for mixing includes:

code for summing the weighted first audio input and the weighted second audio input.

19. The computer-readable medium of claim 17, wherein the code for mixing includes code for selectively combining the weighted first audio input and the weighted second audio input by:

including only the weighted first audio input in the output audio;

including only the weighted second audio input in the output audio; or including both the weighted first audio input and the weighted second audio input in the output audio.

20. The computer-readable medium of claim 17, wherein the first audio input represents voice.

21. The computer-readable medium of claim 20, wherein the second audio input represents stereo audio.

22. The computer-readable medium of claim 17, further comprising:

code for receiving a third audio input from a microphone; and code for mixing the weighted first audio input, the weighted second audio input and the third audio input into the output audio.

23. An apparatus, comprising:

means for receiving, at a first transceiver included in a wireless headset, a first audio input from a first source;

means for receiving, at a second transceiver included in the wireless headset, a second audio input from a second source;

means for storing a plurality of audio signal weighting coefficient sets in a memory included in the wireless headset, wherein each of the weighting coefficient sets corresponds to a predetermined mix of the first audio input and the second audio input and includes a plurality of programmable digital weighting coefficient values;

means for changing the weighting coefficient values stored in the memory;

means for selecting one of the weighting coefficient sets stored in the memory, the selected weighting coefficient set associated with a desired mix of the first audio input and the second audio input;

means for retrieving the selected weighting coefficient set from the memory;

means for weighting the first audio input and the second audio input with the weighting coefficient values of the selected weighting coefficient set to produce a weighted first audio input and a weighted second audio input, wherein at least one of the weighting coefficient values weights the first audio input from the first source and at least one other of the weighting coefficient values weights the second audio input from the second source;

means for mixing the weighted first audio input and the weighted second audio input into output audio; and means for outputting the output audio from the wireless headset.

24. The apparatus of claim 23, wherein the mixing means includes:

means for summing the weighted first audio input and the weighted second audio input.

25. The apparatus of claim 23, wherein the mixing means includes means for selectively combining the weighted first audio input and the weighted second audio input by:

including only the weighted first audio input in the output audio;

including only the weighted second audio input in the output audio; or including both the weighted first audio input and the weighted second audio input in the output audio.

26. The apparatus of claim 23, wherein the first audio input represents voice.

27. The apparatus of claim 26, wherein the second audio input represents stereo audio.

28. The apparatus of claim 23, further comprising:

means for receiving a third audio input from a microphone; and means for mixing the weighted first audio input, the weighted second audio input and the third audio input into the output audio.

29. The apparatus of claim 23, wherein each of the receiving means includes a Bluetooth transceiver.

30. The apparatus of claim 23, further comprising means for applying a time-varying gain to at least one of the first audio input or the second audio input.

* * * * *